US008087180B1

(12) United States Patent
Clayton

(10) Patent No.: US 8,087,180 B1
(45) Date of Patent: Jan. 3, 2012

(54) ADJUSTABLE PICTURE FRAME WALL HANGING TEMPLATE SYSTEM

(76) Inventor: David Clayton, Sherman Oaks, CA (US)

( * ) Notice: Subject to any disclaimer, the term of this patent is extended or adjusted under 35 U.S.C. 154(b) by 0 days.

(21) Appl. No.: 12/896,865

(22) Filed: Oct. 2, 2010

(51) Int. Cl.
*G01B 3/14* (2006.01)

(52) U.S. Cl. ..... 33/613; 33/562

(58) Field of Classification Search ..... 33/562, 33/563, 613, 645
See application file for complete search history.

(56) References Cited

U.S. PATENT DOCUMENTS 3,287,814 A * 11/1966 Littmann ..... 33/613
3,530,591 A * 9/1970 Moffitt ..... 33/613
4,220,309 A * 9/1980 Eisen et al. ..... 33/613
4,443,949 A * 4/1984 Newton ..... 33/613
5,076,612 A * 12/1991 Nirmel ..... 33/563
6,684,518 B2 * 2/2004 Voorhees ..... 33/613
6,880,259 B1 * 4/2005 Schultz ..... 33/613
6,952,887 B2 * 10/2005 Muchnik ..... 33/613
RE42,649 E * 8/2011 Schultz ..... 33/613
2002/0124426 A1 * 9/2002 Dewberry ..... 33/613
2009/0313843 A1 * 12/2009 Compton ..... 33/613
2010/0011602 A1 * 1/2010 Houssian et al. ..... 33/613

* cited by examiner

*Primary Examiner* — G. Bradley Bennett

(57) ABSTRACT

The present invention is an adjustable picture frame wall hanging template system and device with adjustable elements to easily determine and visualize the placement and positioning of an object to be hung on a wall. It can be adjusted by size and shape to determine a desired size and shape of an object to be placed on a wall prior to acquisition of the object. It is light weight and can be easily handled for a single person operation and temporarily attached to the wall for hands free viewing.

20 Claims, 12 Drawing Sheets

ADJUSTABLE PICTURE FRAME WALL HANGING TEMPLATE SYSTEM

BACKGROUND

Interior design both residential and commercial includes hanging or mounting objects such as painting, whiteboards, equipment and other items on a wall or other surface. The typical method used in this design activity is to purchase or acquire the item and manually hold it up against the wall or surface to see how it looks. How it looks usually includes size for the space available and positioning on the space. This process is physically difficult to maneuver the object into a level position, repositioning and re-leveling the object to make adjustments to the one viewing while the person doing the holding cannot see the object in position to make their own judgment. Worse is if the object is too large or too small for the space now the costs of replacement for an object of appropriate size can be expense.

DETAILED DESCRIPTION OF THE INVENTION

In a following description, reference is made to the accompanying drawings, which form a part hereof, and in which is shown by way of illustration a specific example in which the invention may be practiced. It is to be understood that other embodiments may be utilized and structural changes may be made without departing from the scope of the present invention.

GENERAL OVERVIEW

It should be noted that the descriptions that follow, for example, in terms of hanging an object on a wall are described for illustrative purposes and the underlying device and system can apply to any type of object using any attachment method permanent or temporary on any surface in any plane of orientation such as vertical, horizontal or inclined. In one embodiment of the present invention it can be used for positioning a staffing calendar board to be attached on a painted drywall partition with screws and drywall anchors. In one embodiment of the present invention it can be used for positioning a framed sales poster to be attached with double sided tape on the inclined hull of a fiberglass ski boat.

Figure 1:
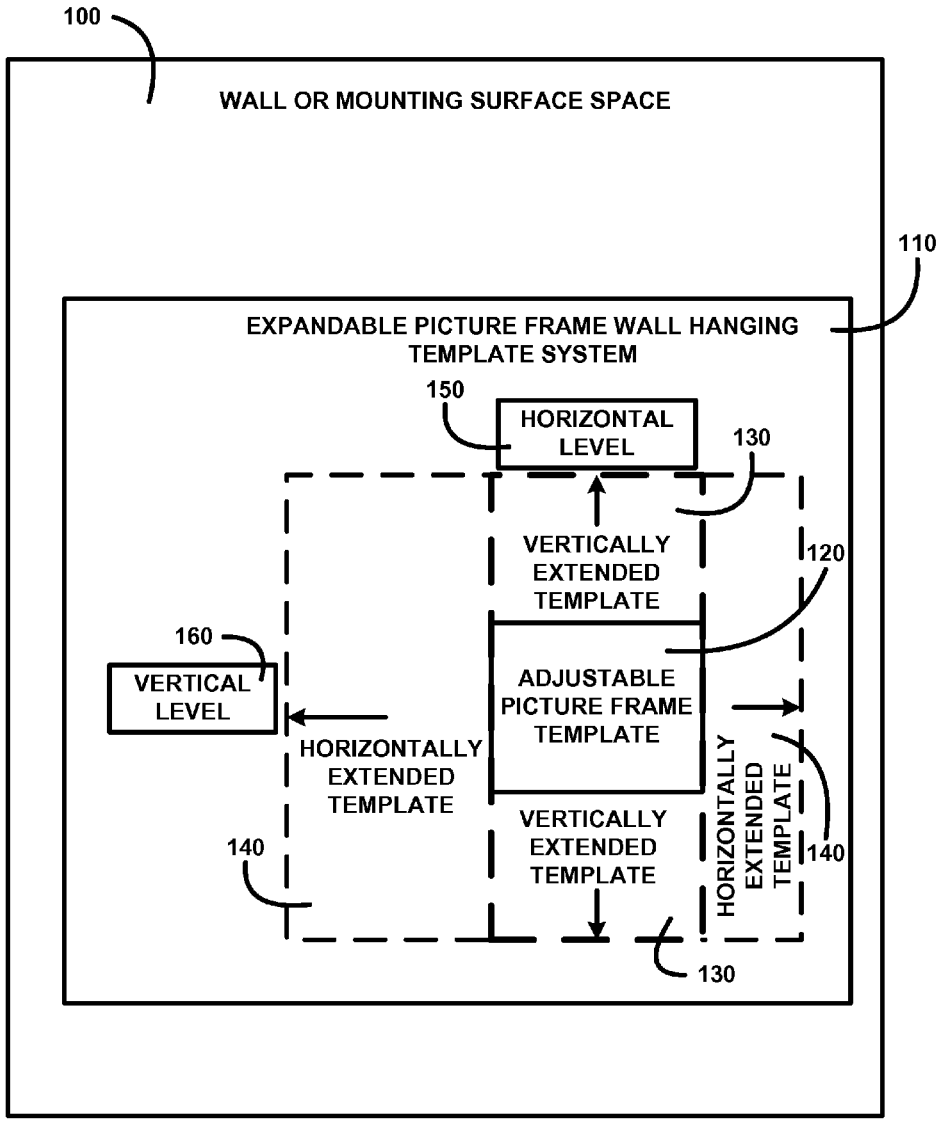
FIG. 1 shows a block diagram of an overview of an adjustable picture frame wall hanging template system of one embodiment of the present invention.

FIG. 1 shows a block diagram of an overview of an adjustable picture frame wall hanging template system of one embodiment of the present invention. FIG. 1 shows a wall or mounting surface space 100 upon which an object is desired to be hung or mounted. Someone desiring to hang any object on a wall for example a picture, mirror or flat screen TV may use for example one of two methods to determine the desired placement position on the wall. One method for example is to enlist another person to hold the object against the wall while they take a step back and give directions as to which way to move the object until they are satisfied with the placement. They then hope that the person holds the object still so they can mark the wall with tape or a pencil. This gets even more difficult when the object is too large or heavy for one person to hold of one embodiment of the present invention.

A second method is to estimate where they would like to hang the item and then put a nail or screw in the wall and hang the item. Then take a step back and hope for the best. If the estimation was wrong, they may try again by placing another hole in the wall. This again gets more complicated with bigger items, which demand more then one screw in the wall to hold it. Even if the item to be hung is small, estimating placement even using measurements is subjective and is in the eye of the beholder, not the eye of the one doing the holding. In another circumstance someone maybe desiring to hang an object on a wall but has not acquired the object and wants to get an idea of not only placement but what size the object should be to provide the desired effect. This may involve drawing various sized shapes on the wall itself or temporarily hang a substitute test object for scaling purposes. This guesswork may lead to poor aesthetic evaluations and subsequent poor acquisitions of objects to hang. The present invention provides a system and devices to allow light weight single person sizing and placement evaluations to be made with ease of one embodiment of the present invention.

An adjustable picture frame wall hanging template system 110 assists with the placement of objects on for example wall surfaces. The adjustable picture frame wall hanging template system 110 includes for example an adjustable picture frame template 120 that can be adjusted in size to match the scale of small or large objects that are to be hung on walls of one embodiment of the present invention.

The adjustable picture frame template 120 can be configured to include for example multiple elements that allow for singular or tandem extension in one or more directions. FIG. 1 shows the placement of the adjustable picture frame template 120 and subsequently vertically adjusted template 130 and horizontally adjusted template 140. The adjustable picture frame wall hanging template system 110 allows for the visualization of various sizes and shapes to suit the desire of the user. The adjustable picture frame template 120 can be configured to include a horizontal level 150 and vertical level 160 to allow the user to more easily determine that the adjusted template shape is being visualized on a desired leveled or angled orientation of one embodiment of the present invention. The adjustable picture frame template 120 can be configured to include one or more vertical and horizontal rulers or measurement devices that allows for expanding the adjustable picture frame template 120 to a predetermined dimension.

The adjustable picture frame template 120 can be configured with temporary adhesive capabilities to allow the adjustable picture frame template 120 in an extended or non-extended position to be affixed to the wall surface for hands free viewing or for example a single person positioning the template, temporarily adhering the template to the wall and standing away from the wall to view the template to check for desired sizing and positioning. The adjustable picture frame template 120 can be manufactured of very light materials for example plastics, aluminum or other light weight materials to allow for less strenuous effort in determining the placement position of an object on the mounting surface such as a wall of one embodiment of the present invention.

DETAILED DESCRIPTION

Figure 2:
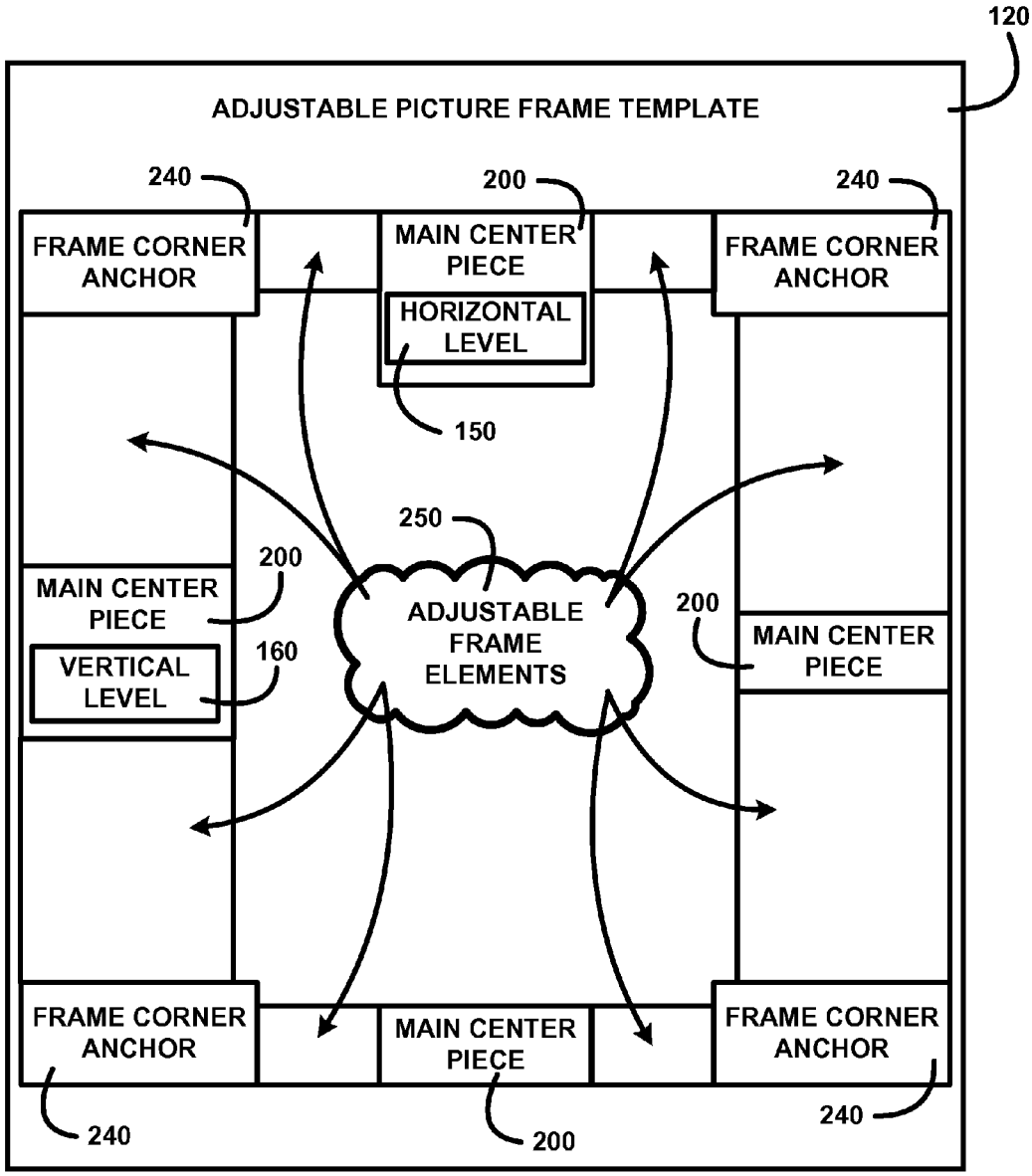
FIG. 2 for illustrative purposes only is a block diagram of some elements of the adjustable picture frame template of one embodiment of the present invention.

FIG. 2 for illustrative purposes only is a block diagram of some elements of the adjustable picture frame template of one embodiment of the present invention. Shown in FIG. 2 is the adjustable picture frame template 120 configured with a main center piece 200 on top, a bottom main center piece 200, a left main center piece 200 and a right main center piece 200. The main center pieces act as housings or containers for adjustable frame elements 250. Each pairing of perpendicularly oriented adjustable frame elements 250 are connected by a frame corner anchor 240. The frame corner anchor 240 can be configured for example to house devices which provide a portion of the adjustable frame elements 250 operation or other devices for example laser light emitters, electronic circuits, control systems and/or power source elements such as battery compartments for other operations and/or aesthetic value of one embodiment of the present invention.

Shown in FIG. 2 the top main center piece 200 configured for example with the horizontal level 150 attached to determine when the positioning is in a level horizontal orientation. Also shown is the left main center piece 200 configured for example with the vertical level 160 attached to determine when the positioning is vertically oriented plumb to the horizontal. The leveling elements can be configured to be attached to any main center piece 200 or the frame corner anchor 240 elements of one embodiment of the present invention.

The adjustable picture frame template 120 can be used for example by laying the object to hang flat on the floor and placing the adjustable picture frame template above the object allowing for the adjustment of the template to the height and width of the object. The adjustable picture frame template 120 can then be placed on the wall and temporarily attached by pressing firmly on the points of the template that contain the adhesive elements, step back and observe. If the placement does not create the desired effect then simply detach the adjustable picture frame template 120 from the wall, move and reattach it to the wall. When the desired placement is determined, mark the position on the wall and remove the template. Now place for example the screw in the wall and hang the object. The desired placement is achieved without guesswork and the object hung on the wall with confidence of one embodiment of the present invention.

Figure 3A:
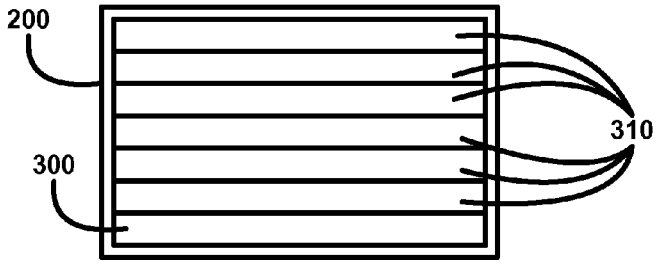
FIG. 3A for illustrative purposes only shows an example of the main center piece housing adjustable frame elements end view of one embodiment of the present invention.

Main Center Piece:

FIG. 3A for illustrative purposes only shows an example of the main center piece housing adjustable frame elements end view of one embodiment of the present invention. Shown in FIG. 3A is the main center piece 200 of which there are four as shown in FIG. 2. The main center piece 200 acts as a housing to contain as shown in FIG. 3A an example of adjustable frame elements 310 and frame corner anchor 300 portion connected to the adjustable frame elements 310. The main center piece 200 can for example be configured as a box, cube or cylinder to match the shape configuration of the adjustable frame elements 310. The main center piece 200 can for example be configured to include a plastic bubble levels or some device to help with leveling. The surface of the main center piece 200 which faces the wall can be configured for example with a temporary wall attachment element to secure the adjustable picture frame template 120 of FIG. 1 to the wall. The main center piece 200 can be configured with for example center aligned notches or drilled holes to allow the user to mark where to put the nail or screw for the final position desired of one embodiment of the present invention.

Figure 3B:
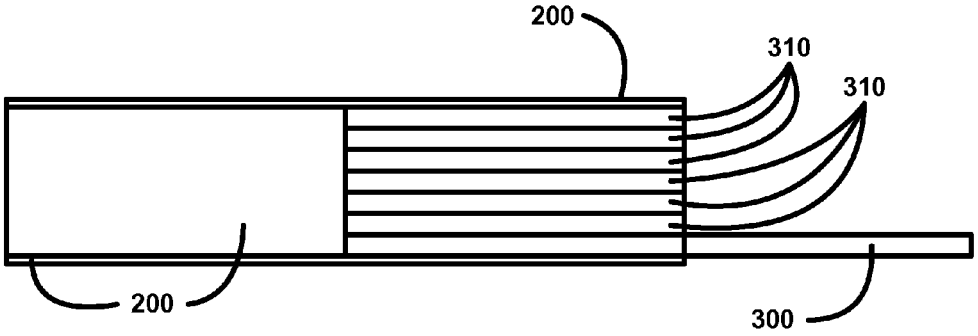
FIG. 3B for illustrative purposes only shows an example of the main center piece housing adjustable frame elements side view of one embodiment of the present invention.

FIG. 3B for illustrative purposes only shows an example of the main center piece housing adjustable frame elements side view of one embodiment of the present invention. The side view of FIG. 3B shows the frame corner anchor 300 and adjustable frame elements 310 housed in the main center piece 200 prior to being extended of one embodiment of the present invention.

Figure 3C:
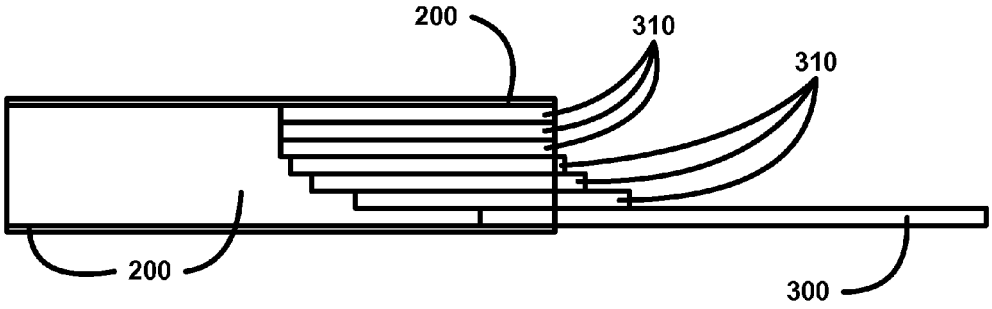
FIG. 3C for illustrative purposes only shows an example of the main center piece side view with some partially extended adjustable frame elements of one embodiment of the present invention.

FIG. 3C for illustrative purposes only shows an example of the main center piece side view with some partially extended adjustable frame elements of one embodiment of the present invention. The side view of FIG. 3C shows for example a portion of the frame corner anchor 300 partially extended from the main center piece 200. Also shown are for example three adjustable frame elements 310 partially extended from the main center piece 200 and three adjustable frame elements 310 not extended from the main center piece 200 of one embodiment of the present invention.

Figure 4A:
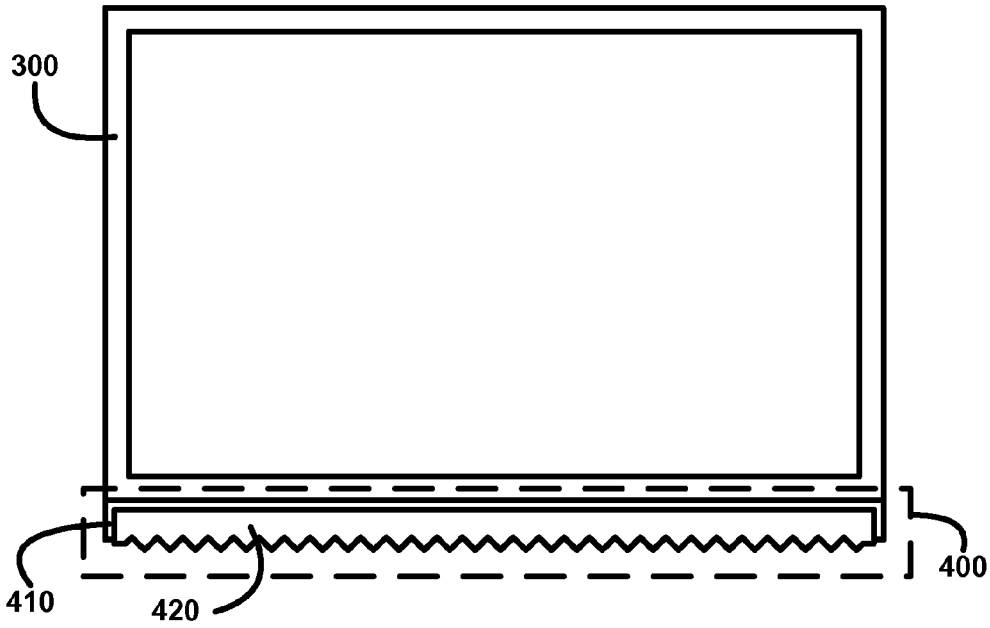
FIG. 4A for illustrative purposes only shows an example of a temporary adhesive wall attachment element of one embodiment of the present invention.

Temporary Wall Attachment Element:

FIG. 4A for illustrative purposes only shows an example of a temporary adhesive wall attachment element of one embodiment of the present invention. The adjustable picture frame template 120 of FIG. 1 can be configured for example with temporary adhesive wall attachment 400 element mounted on the wall facing surface of the main center piece 200 and/or frame corner anchor 240 of FIG. 2. A sticky adhesive mounting tray 410 can be attached to the main center piece 200 and contain a sticky adhesive 420. An example of the sticky adhesive 420 can be unvulcanized sticky rubber pads. Another example of the sticky adhesive 420 can be rubber cement placed in the sticky adhesive mounting tray 410. The sticky substance can be strong enough to hold the adjustable picture frame template 120 of FIG. 1 to a wall but will allow for easy removal and repositioning on the wall of one embodiment of the present invention.

Figure 4B:
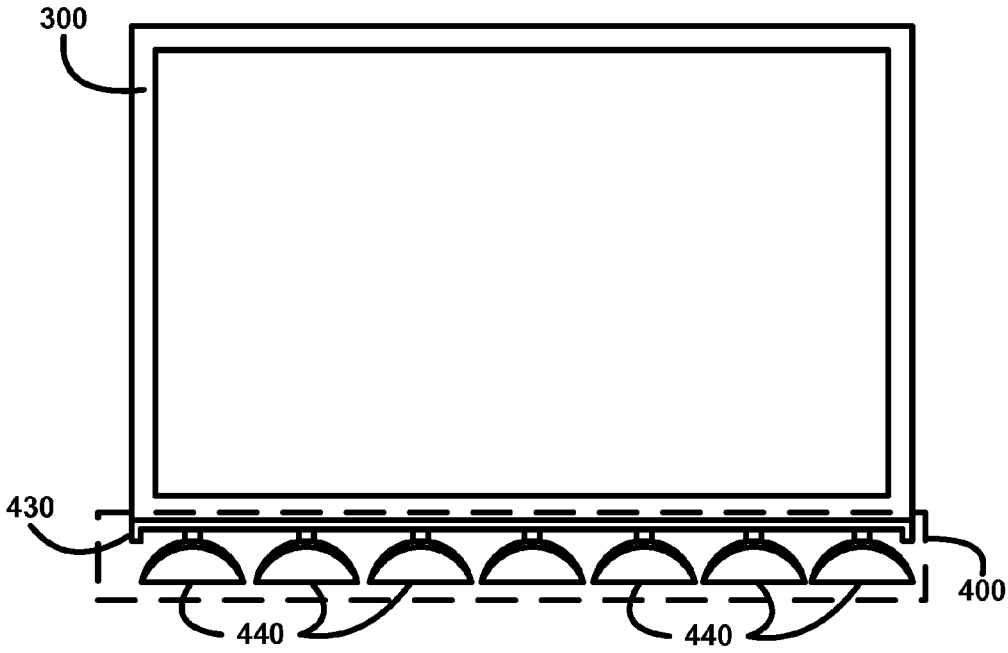
FIG. 4B for illustrative purposes only shows an example of a temporary suction cup wall attachment element of one embodiment of the present invention.

FIG. 4B for illustrative purposes only shows an example of a temporary suction cup wall attachment element of one embodiment of the present invention. The adjustable picture frame template 120 of FIG. 1 can be configured with temporary adhesive wall attachment 400 element configured with a suction cup adhesive mounting tray 430 can be attached to the main center piece 200 and contain one or more suction cups 440. For example a checker board array of suction cups attached to the suction cup adhesive mounting tray 430 when pressed against the wall surface can hold the adjustable picture frame template 120 of FIG. 1 in place for hands free viewing. One or more suction cup 440 elements attached to each main center piece 200 can be strong enough to hold the adjustable picture frame template 120 of FIG. 1 to a wall but will allow for easy removal and repositioning on the wall of one embodiment of the present invention.

Adjustable Frame Elements:

The adjustable frame elements 250 of FIG. 2 allow by extension the adjustable picture frame template 120 of FIG. 1 to be adjusted by the user to fit various sizes and shapes of an object desired to be hung on a wall. The adjustable picture frame wall hanging template system 110 of FIG. 1 can provide multiple configurations of the adjustable frame elements 250 of FIG. 2. The adjustable frame elements 250 of FIG. 2 and other elements of the adjustable picture frame template 120 of FIG. 1 can be configured to include for example measurement markings using metric or imperial units to allow easy determination of actual length, height or width to adjust the template to the height and width of the object to be hung. The following illustrations in FIGS. 5A, 5B, 5C, 6A, 6B, 7A, 7B, 7C, 8A, 8B, and 8C provide descriptions and operations of examples of adjustable frame elements 250 of FIG. 2 but configurations of the adjustable frame elements 250 of FIG. 2 are not limited to only these examples of one embodiment of the present invention.

Figure 5A:
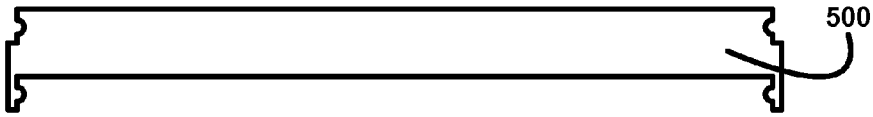
FIG. 5A for illustrative purposes only shows an example of an adjustable frame element telescoping channeled panel end view of one embodiment of the present invention.

Telescoping Channeled Panel:

FIG. 5A for illustrative purposes only shows an example of an adjustable frame element telescoping channeled panel end view of one embodiment of the present invention. FIG. 5A shows the channels of an adjustable frame element telescoping channeled panel 500. The channels allow each telescoping channeled panel 500 to slide along the path of the channel in an interlocking manner with adjacent panels. The telescoping channeled panel 500 can for example be made of light weight plastics or other light weight materials. The channels can be configured in various patterns that allow each telescoping channeled panel 500 to slide with varying degrees of tension or friction of one embodiment of the present invention.

Figure 5B:
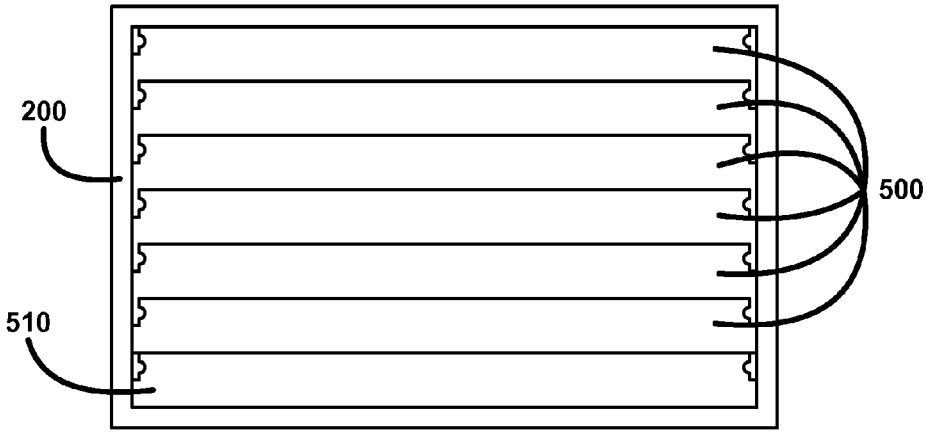
FIG. 5B for illustrative purposes only shows an example of an adjustable frame element telescoping channeled panel assembly end view of one embodiment of the present invention.

FIG. 5B for illustrative purposes only shows an example of an adjustable frame element telescoping channeled panel assembly end view of one embodiment of the present invention. The number of telescoping channeled panel 500 elements that can be assembled and housed in the main center piece 200 can be varied to allow varying lengths of extension possible for adjusting the size of the adjustable picture frame template 120 of FIG. 1. FIG. 5B shows a frame corner anchor 510 that has a portion of the frame corner anchor element channeled to match the telescoping channeled panel 500 that will be mated to and connected to the frame corner anchor 510 of one embodiment of the present invention.

Figure 5C:
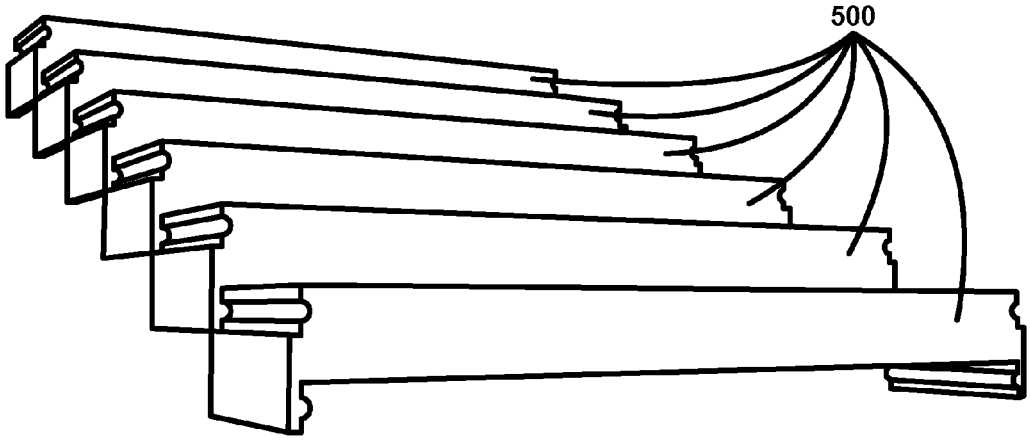
FIG. 5C for illustrative purposes only shows an example of an adjustable frame element telescoping channeled panel extended assembly prospective view of one embodiment of the present invention.

FIG. 5C for illustrative purposes only shows an example of an adjustable frame element telescoping channeled panel extended assembly prospective view of one embodiment of the present invention. The assembly of telescoping channeled panel 500 elements shown in FIG. 5C are extended by sliding of each consecutive panel along the channels. The tiered extension of the telescoping channeled panel 500 elements provides added length and/or width to the adjustable picture frame template 120 of FIG. 1. Upon completion of the placement positioning operation the extended telescoping channeled panel 500 elements can be slid back into a closed position inside the main center piece 200 for resizing or storage of one embodiment of the present invention.

Figure 6A:
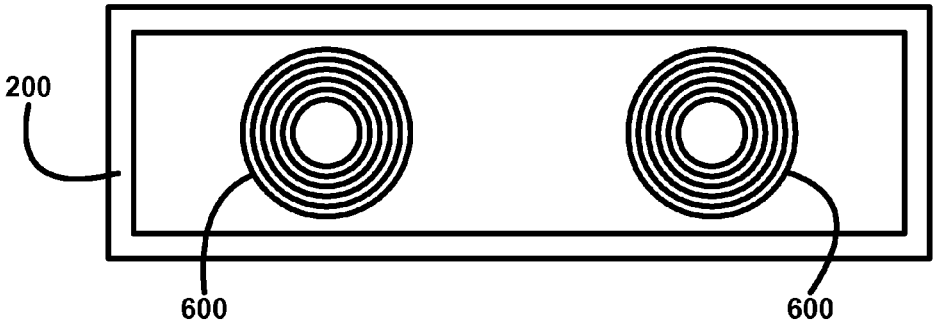
FIG. 6A for illustrative purposes only shows an example of an adjustable frame element telescoping tube end view of one embodiment of the present invention.

Telescoping Tube:

FIG. 6A for illustrative purposes only shows an example of an adjustable frame element telescoping tube end view of one embodiment of the present invention. Shown housed in the main center piece 200 in FIG. 6A are two adjustable frame elements configured as a telescoping tube 600. The concentric tubes are varied in diameter to allow each to slide within the adjacent larger tube in a telescoping operation. The telescoping tube 600 assembly provides added length and/or width to the adjustable picture frame template 120 of FIG. 1. Upon completion of the placement positioning operation the extended telescoping tube 600 elements can be slid back into a closed position inside the main center piece 200 for resizing or storage of one embodiment of the present invention.

Figure 6B:
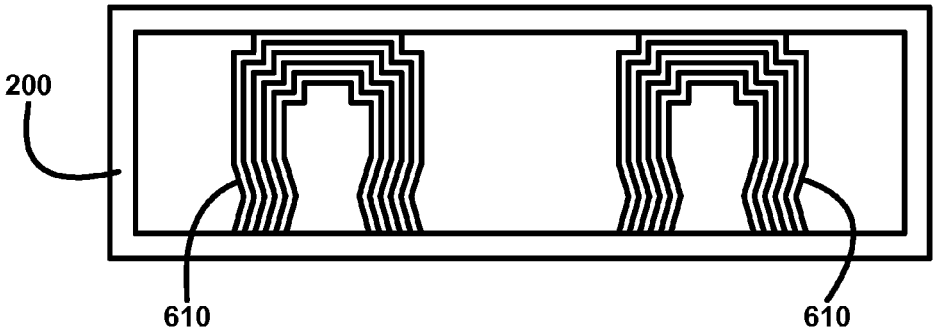
FIG. 6B for illustrative purposes only shows an example of an adjustable frame element telescoping rail end view of one embodiment of the present invention.

Telescoping Rail:

FIG. 6B for illustrative purposes only shows an example of an adjustable frame element telescoping rail end view of one embodiment of the present invention. Shown housed in the main center piece 200 in FIG. 6B are two adjustable frame elements configured as a telescoping rail 610. Each successive telescoping rail 610 is reduced in size to allow each to slide or ride the rail beneath it as extended. The telescoping rail 610 assembly provides added length and/or width to the adjustable picture frame template 120 of FIG. 1. Upon completion of the placement positioning operation the extended telescoping rail 610 elements can be slid back into a closed position inside the main center piece 200 for resizing or storage of one embodiment of the present invention.

Figure 7A:
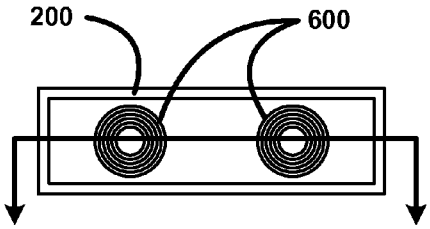
FIG. 7A for illustrative purposes only shows the section view point for an example of the telescoping tube adjustable frame element end view of one embodiment of the present invention.

Telescoping Tube Operation:

FIG. 7A for illustrative purposes only shows the section view point for an example of the telescoping tube adjustable frame element end view of one embodiment of the present invention. FIG. 7A indicates the section line for the main center piece 200 and the two telescoping tube 600 adjustable frame elements described in FIGS. 7B and 7C of one embodiment of the present invention.

Figure 7B:
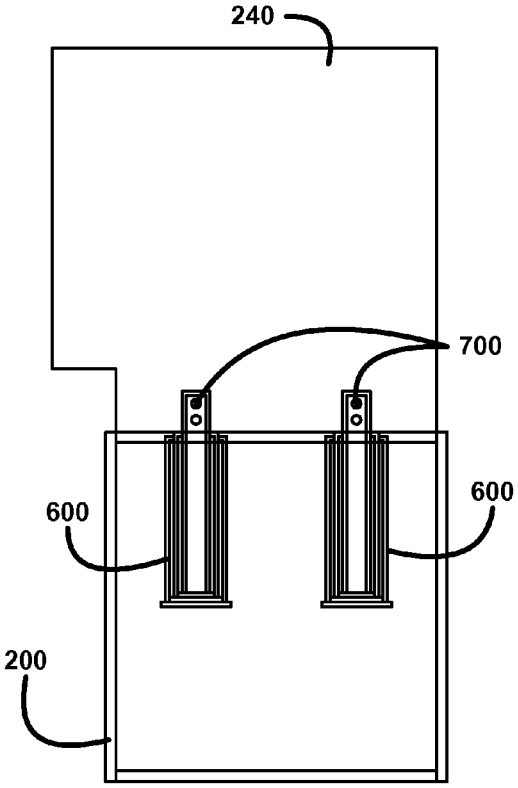
FIG. 7B for illustrative purposes only shows an example of an unextended telescoping tube adjustable frame element section view of one embodiment of the present invention.

FIG. 7B for illustrative purposes only shows an example of an unextended telescoping tube adjustable frame element section view of one embodiment of the present invention. FIG. 7B shows an assembly of telescoping tube 600 adjustable frame elements housed within the main center piece 200 before being extended. The telescoping tube corner anchor attachment 700 of the inner tube element is connected to the frame corner anchor 240 of one embodiment of the present invention.

Figure 7C:
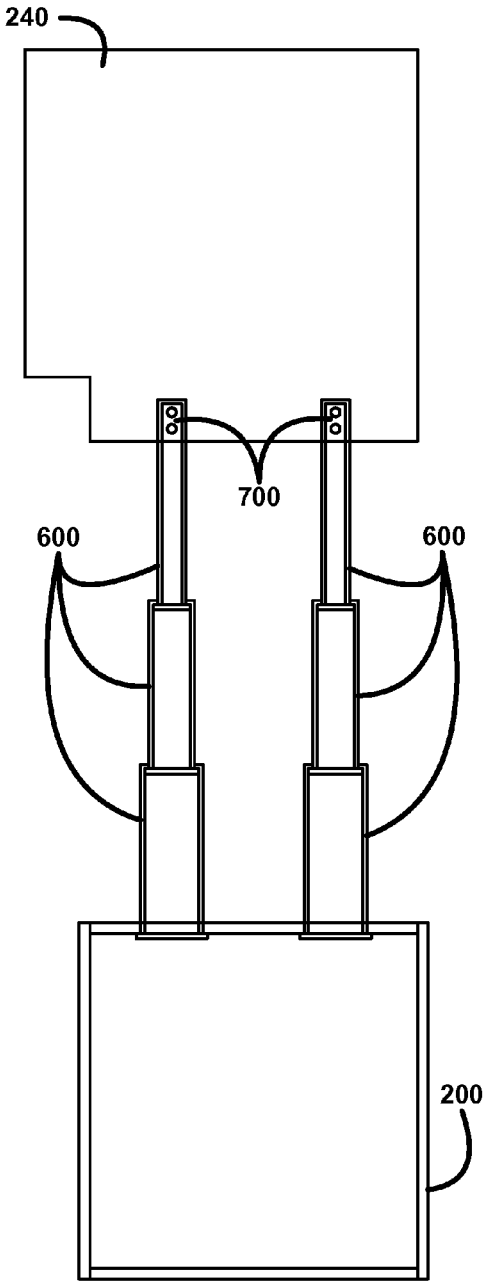
FIG. 7C for illustrative purposes only shows an example of an extended telescoping tube adjustable frame element section view of one embodiment of the present invention.

FIG. 7C for illustrative purposes only shows an example of an extended telescoping tube adjustable frame element section view of one embodiment of the present invention. FIG. 7C shows the results of the pulling of the frame corner anchor 240 away from the main center piece 200. As the frame corner anchor 240 is pulled the telescoping tube corner anchor attachment 700 allows the telescoping tube 600 elements to successively be extended away from the main center piece 200. The telescoping tube 600 elements can be partially or fully extended to allow the adjustable picture frame template 120 of FIG. 1 to be adjusted to the desired length, height or width of one embodiment of the present invention.

Figure 8A:
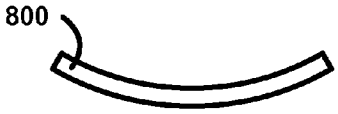
FIG. 8A for illustrative purposes only shows an example of an adjustable frame element curved ribbon end view of one embodiment of the present invention.

Retractable Curved Ribbon:

FIG. 8A for illustrative purposes only shows an example of an adjustable frame element curved ribbon end view of one embodiment of the present invention. An example shown in FIG. 8A of the adjustable frame elements 250 of FIG. 2 is a curved ribbon 800. The curved shape allows the ribbon to be stiff after being extended and sufficiently flexible to be coiled when not extended. The curved ribbon 800 can for example be made of coated steel, other suitable metals or plastics or composite materials that are durable and have the physical properties to be stiff when extended and flexible to be coil when not extended of one embodiment of the present invention.

Figure 8B:
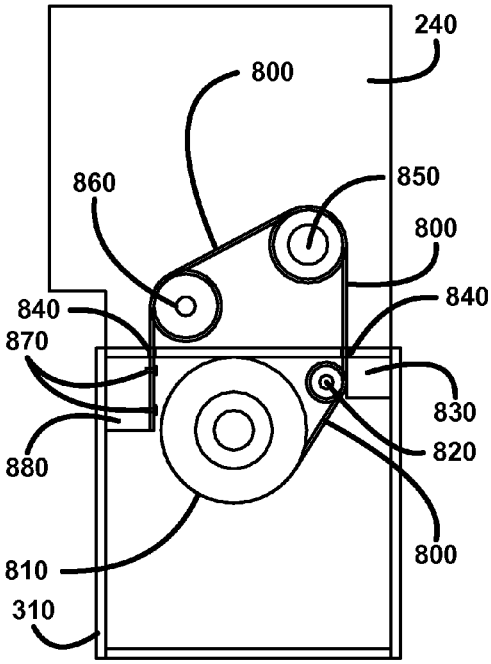
FIG. 8B for illustrative purposes only shows an example of an adjustable frame element unextended retractable curved ribbon assembly plan view of one embodiment of the present invention.

FIG. 8B for illustrative purposes only shows an example of an adjustable frame element unextended retractable curved ribbon assembly plan view of one embodiment of the present invention. Shown in the FIG. 8B plan view are the frame corner anchor 240 and main center piece 200 each of which house portions of the retractable curved ribbon 800 assembly. In the unextended FIG. 8B plan view the majority of the curved ribbon 800 is coiled on a retractable spring coil reel 810. A lead portion of the curved ribbon 800 passes along a path created by a spindle 820 and a guide block 830 then exits the main center piece 200 through a profiled slot 840. The slot is configured to match the curved profile of the curved ribbon 800 which allows the ribbon to be properly aligned of one embodiment of the present invention.

The lead portion of the curved ribbon 800 continues into the frame corner anchor 240 around the matching profile of a redirecting spindle 850 and alignment spindle 860 before exiting the frame corner anchor 240. Upon reentering the main center piece 200 through another profiled slot 840 it is then attached to a ribbon attachment block 880. The attachment to the block is made using two or more ribbon attachment pin 870 elements. This ribbon attachment prevents the curved ribbon 800 from retracting fully onto the retractable spring coil reel 810 of one embodiment of the present invention.

Figure 8C:
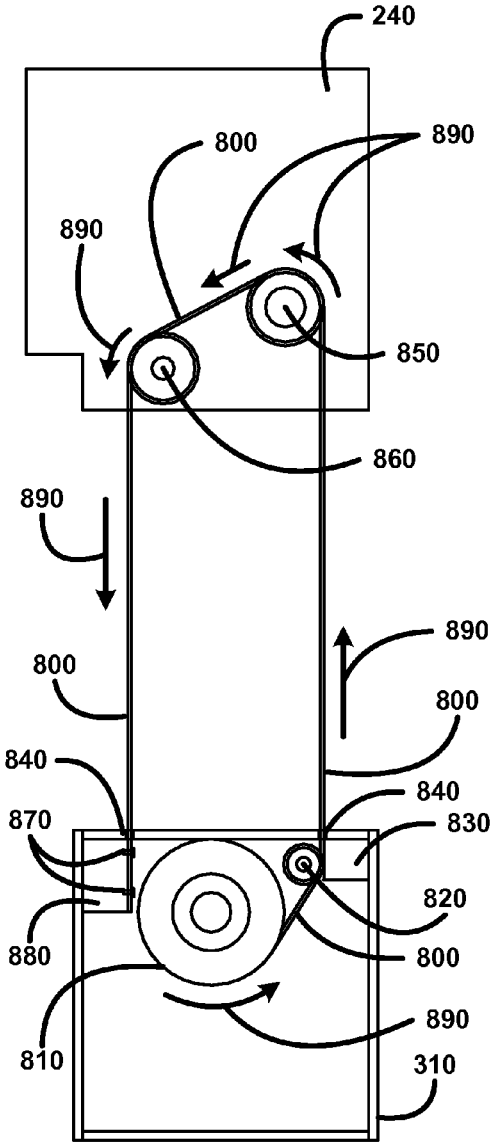
FIG. 8C for illustrative purposes only shows an example of an adjustable frame element extended retractable curved ribbon assembly plan view of one embodiment of the present invention.

FIG. 8C for illustrative purposes only shows an example of an adjustable frame element extended retractable curved ribbon assembly plan view of one embodiment of the present invention. Shown in the FIG. 8C plan view is the main center piece 200 which houses the retractable spring coil reel 810 on which the majority of the curved ribbon 800 is coiled. As the frame corner anchor 240 is pulled away from the main center piece 200 the curved ribbon 800 is played out from the retractable spring coil reel 810 in a curved ribbon play out direction 890. The proper tension and alignment of the curved ribbon 800 is maintained by passing through the path created by the spindle 820, the guide block 830 and the profiled slot 840. The curved ribbon play out direction 890 leads directly to the redirecting spindle 850 in the frame corner anchor 240. The redirecting spindle 850 uses the flexibility of the concave side of the curve to turn the curved ribbon 800 toward the alignment spindle 860 of one embodiment of the present invention.

Equal distances are maintained between the frame corner anchor 240 and main center piece 200 as additional lengths of curved ribbon 800 play off the retractable spring coil reel 810. The spring ratchet in the retractable spring coil reel 810 locks once the desired extension has been reached and the pulling is stopped. The tension created through the locked ratchet and the ribbon attachment block 880 and ribbon attachment pin 870 connection maintains a stiff condition of the curved ribbon 800. The user only starts a gentle pull to unlock the ratchet to retract the curved ribbon 800 of one embodiment of the present invention.

Figure 9A:
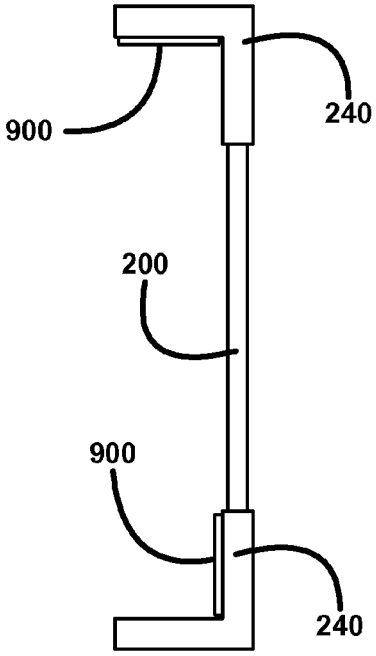
FIG. 9A for illustrative purposes only shows an example of an adjustable picture frame template section unextended with a laser light emitter plan view of one embodiment of the present invention.

Laser Frame Template:

FIG. 9A for illustrative purposes only shows an example of an adjustable picture frame template section unextended with a laser light emitter plan view of one embodiment of the present invention. Shown in FIG. 9A is an example of narrow adjustable frame elements 250 of FIG. 2 wherein the frame corner anchor 240 can be configured with a laser light emitter 900. The laser light emitter 900 can project a wide band of for example colored light on the wall surface to increase the area of the image being viewed by the user. The larger image can allow the user to more easily visualize the potential size of the object to be hung on the wall. Each frame corner anchor 240 can for example be configured with a laser light emitter 900 oriented to project the wide band of light toward the interior of the area bounded by the template. The orientations of each laser light emitter 900 can include left, right, up and down to parallel a side of the template and create the illusion of a wider frame edge. FIG. 9A shows for example the main center piece 200 configured as a cylinder which can house within the cylinder the unextended narrow adjustable frame elements 250 of FIG. 2 of one embodiment of the present invention.

Figure 9B:
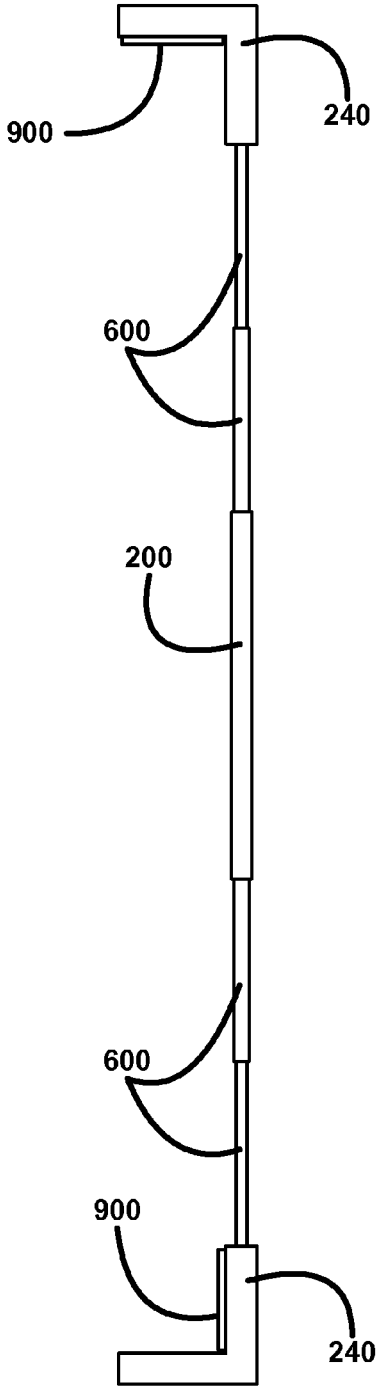
FIG. 9B for illustrative purposes only shows an example of an adjustable picture frame template section extended with a laser light emitter plan view of one embodiment of the present invention.

FIG. 9B for illustrative purposes only shows an example of an adjustable picture frame template section extended with a laser light emitter plan view of one embodiment of the present invention. FIG. 9B shows the adjustable frame elements 250 of FIG. 2 configured for example as telescoping tube 600 assemblies. The laser light emitter 900 angle of projecting the wide band of light is adjusted as the telescoping tube 600 sections are extended from the main center piece 200 to compensate as the frame edge is lengthened. The same frame corner anchor 240 to which the laser light emitter 900 is attached for example can house the battery source and control systems for each laser light emitter 900 of one embodiment of the present invention.

Figure 10:
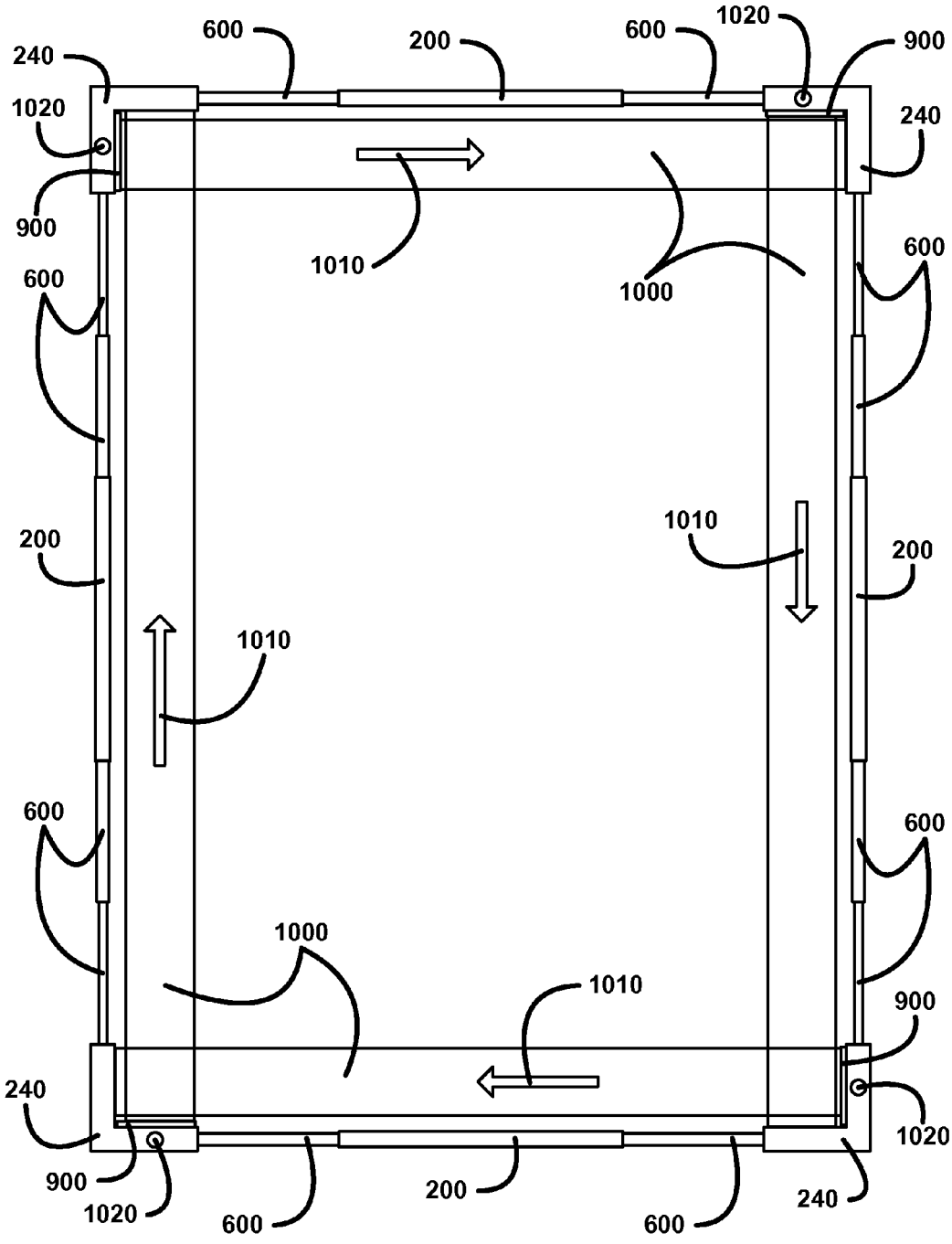
FIG. 10 for illustrative purposes only shows an example of an adjustable picture frame template partially extended with laser light emitters plan view of one embodiment of the present invention.

FIG. 10 for illustrative purposes only shows an example of an adjustable picture frame template partially extended with laser light emitters plan view of one embodiment of the present invention. FIG. 10 shows the main center piece 200 elements, telescoping tube 600 assemblies and frame corner anchor 240 elements with laser light emitter 900 elements described in FIG. 9A and FIG. 9B in a four sided assemblage. The frame corner anchor 240 elements can for example be configured with an on and off switch or button 1020 to operate the laser light emitter 900 elements. Activating the on and off switch or button 1020 to the on position for example enables the laser light emitter 900 to project a band of projected laser light 1010. Each laser light emitter 900 on the four frame corner anchor 240 elements shown in FIG. 10 is oriented to produce a different direction of projected laser light 1010. The four direction orientation creates a band of projected laser light 1000 along the four interior sides of the adjustable picture frame template 120 of FIG. 1. The illuminated effect aids the user to more easily visualize the potential size of the object to be hung on the wall of one embodiment of the present invention.

Figure 11:
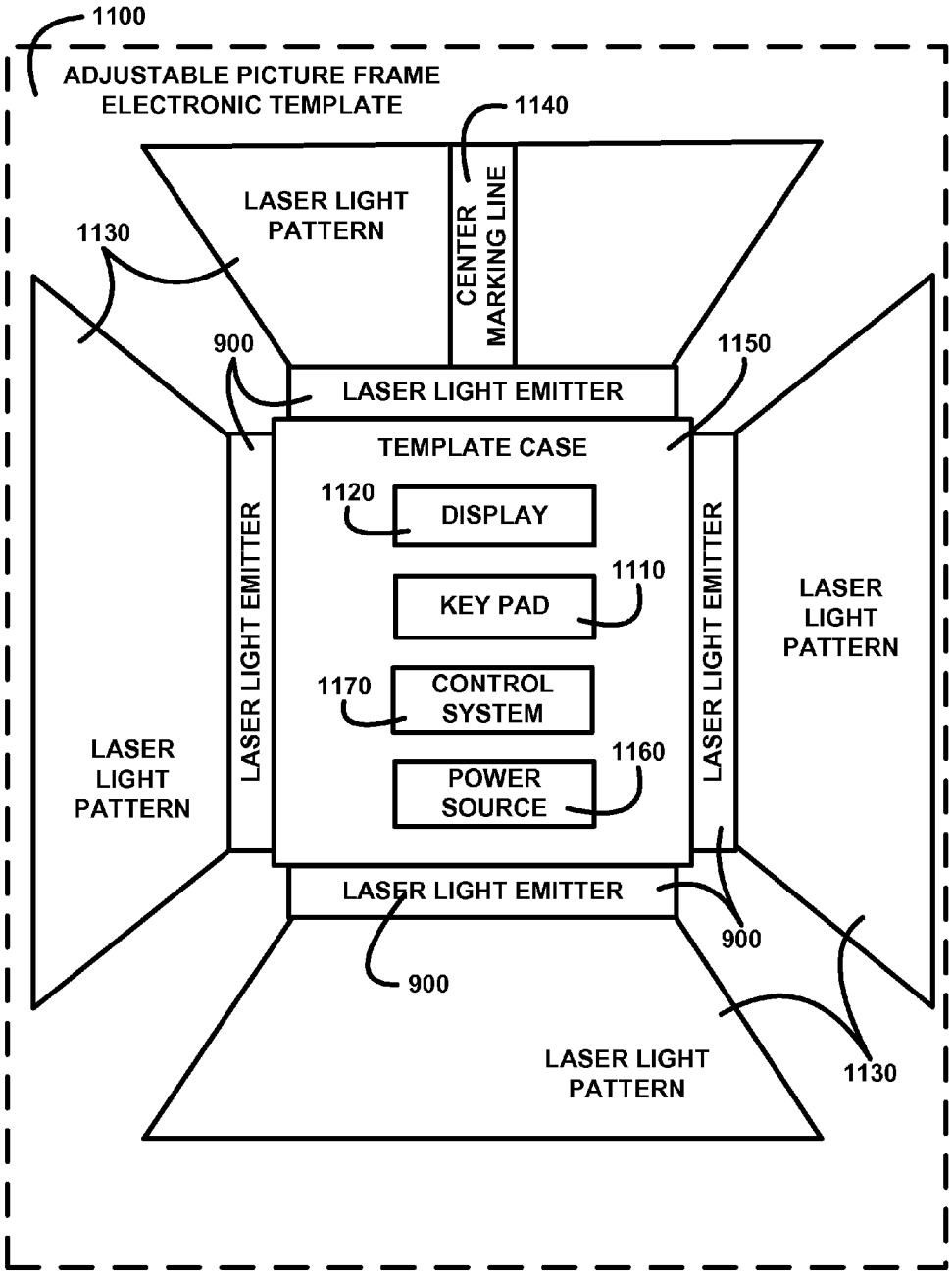
FIG. 11 for illustrative purposes only is a block diagram of some elements of an adjustable picture frame electronic template with laser light emitters of one embodiment of the present invention.

Adjustable Picture Frame Electronic Template:

FIG. 11 for illustrative purposes only is a block diagram of some elements of an adjustable picture frame electronic template with laser light emitters of one embodiment of the present invention. FIG. 11 shows an adjustable picture frame electronic template 1100. The adjustable picture frame electronic template 1100 configured to include an electronic template case 1150 to attach multiple adjustable picture frame electronic template elements. The adjustable picture frame electronic template 1100 configured to include a key pad 1110 which can for example be a 10 key numeric pad or an alpha numeric pad that includes letters and symbols. The key pad 1110 is operated by the user to input the desired dimensions of the object template to be displayed on the wall surface. The key pad 1110 can be configured to include a digital memory device to store the user input dimensions for future one-click size inputs. The key pad 1110 can be configured to include preset default pre-determined sizes for example 8"×10" or 3'×5'. The adjustable picture frame electronic template 1100 is configured with a display 1120 to enable the user to read the dimensions inputted to size a projected laser light pattern 1130 of one embodiment of the present invention.

The projected laser light pattern 1130 is created using four or more laser light emitter 900 elements configured to project laser light onto the wall surface. Each laser light emitter 900 configured along a side of the adjustable picture frame electronic template 1100 projects a broad angular light pattern. The adjustable picture frame electronic template 1100 is configured with a control system 1170 which for example can include mechanical and electronic control systems to adjust the projection angle of the laser light emitter 900 to project a point on the wall surface to match the desired dimensions inputted by the user of one embodiment of the present invention.

Each laser light emitter 900 elements can be configured to return to a starting position facing perpendicularly toward the wall and the dimensions reinitiated to zero values. The user turning the adjustable picture frame electronic template 1100 on for operation and inputting specific dimensions resets the dimension values. The projection angle begins rotation and the projected laser light pattern 1130 angular illumination begins to spread out on the wall. The projection angle stops rotating when the angle of projection reaches the point where the projected laser light pattern 1130 equals the desired dimensions inputted by the user have been reached of one embodiment of the present invention.

The adjustable picture frame electronic template 1100 can be relocated to a different position using the temporary adhesive wall attachment 400 of FIG. 4A or FIG. 4B to visualize the object image at a different location. The adjustable picture frame electronic template 1100 can be configured for example with an on/off switch or button. The adjustable picture frame electronic template 1100 can be configured for example with a reset button to zero the input dimensions and return the projection angle of the laser light emitter 900 elements to a home position. The adjustable picture frame electronic template 1100 can be configured for example with a power source system such as a battery or rechargeable battery compartment and connections. The user can input new dimensions to adjust the object image at the same location to determine the desired size that best meets the desired effect. The user can mark the wall surface using the projected laser light as a guide. The adjustable picture frame electronic template 1100 can be configured for example to project a center marking line 1140 configured as a different color, shadow or silhouette to indicate the center of a projected laser light pattern. The user can for example use the boundary edge of the projected laser light pattern 1130 angular illumination and the center marking line 1140 to accurately mark the center position for the placement of a nail, screw or hanging device on the wall of one embodiment of the present invention.

Figure 12A:
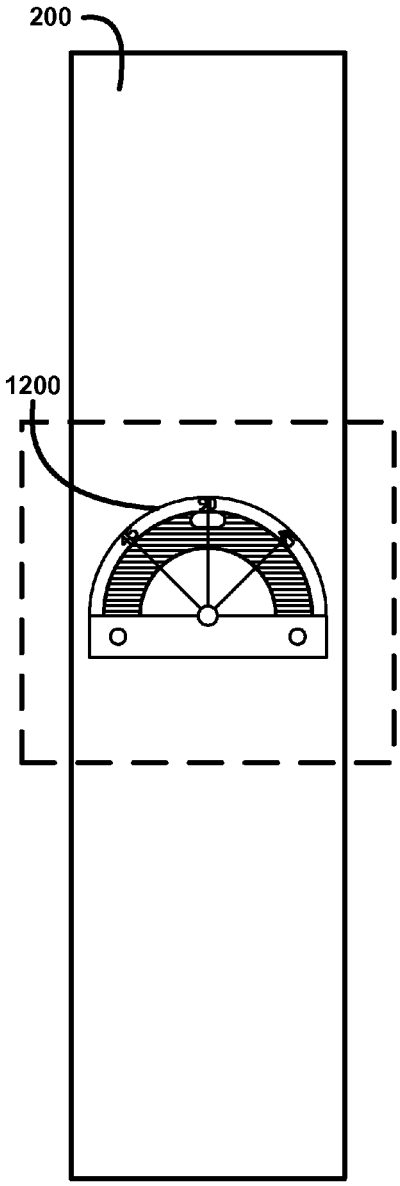
FIG. 12A for illustrative purposes only shows an example of a vertical leveling element installation plan view of one embodiment of the present invention.

Leveling Elements:

FIG. 12A for illustrative purposes only shows an example of a vertical leveling element installation plan view of one embodiment of the present invention. Leveling elements for both horizontal and vertical level determination can be configured on the adjustable picture frame template 120 of FIG. 1. FIG. 12A shows a vertical level 1200 installed for example on the side of the main center piece 200. The vertical level 1200 is used to determine any desired incline in the hanging of the object or any non-vertical condition in the wall surface of one embodiment of the present invention.

Figure 12B:
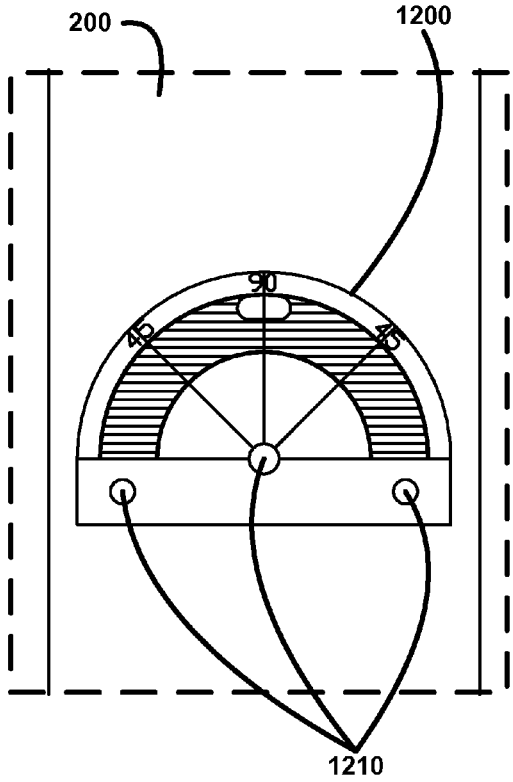
FIG. 12B for illustrative purposes only shows an example of a vertical leveling element installation enlarged plan view of one embodiment of the present invention.

FIG. 12B for illustrative purposes only shows an example of a vertical leveling element installation enlarged plan view of one embodiment of the present invention. Shown in FIG. 12B are the degrees of angle markings on the vertical level 1200. These can be used to determine based on the location of the suspended bubble whether any incline is present. The vertical level 1200 is installed on the main center piece 200 by inserting snap pins 1210 into predrilled holes in the main center piece 200. Inserting the snap pins 1210 into the predrilled holes provides proper alignment with the adjustable picture frame template 120 of FIG. 1 of one embodiment of the present invention.

The foregoing has described the principles, embodiments and modes of operation of the present invention. However, the invention should not be construed as being limited to the particular embodiments discussed. The above described embodiments should be regarded as illustrative rather than restrictive, and it should be appreciated that variations may be made in those embodiments by workers skilled in the art without departing from the scope of the present invention as defined by the following claims.

What is claimed is:

1. An adjustable picture frame wall hanging template system for determining the desired placement, positioning and size of an object to be hung on a surface such as a wall using a device temporarily positioned on the surface for visualizing the object in place prior to being hung, comprising:

an adjustable light weight device configured to be temporarily positioned on the surface for visualizing the object in place prior to being hung having multiple adjustable frame elements to form an adjustable picture frame template;

wherein the adjustable picture frame template includes one or more temporary adhesive elements to temporarily adhere the template to the surface in a desired position;

wherein the temporary adhesive element is configured to allow the template to be easily removed and repositioned to allow for operations such as leveling; and a leveling element configured to allow the adjustment of the orientation of the adjustable picture frame template to a horizontal level;

wherein the leveling element is configured to allow the adjustment of the orientation of the adjustable picture frame template to a user satisfied horizontal and vertical level.

2. The adjustable picture frame wall hanging template system of claim 1, wherein the multiple adjustable frame elements are configured to be manufactured of light materials of at least one of plastics or aluminum, to allow for less strenuous effort when positioning on a surface.

3. The adjustable picture frame wall hanging template system of claim 1, wherein the adjustable picture frame template includes adjustable frame elements that includes physical devices and projected visible light patterns.

4. The adjustable picture frame wall hanging template system of claim 1, wherein the adjustable picture frame template is configured to adjust and match a size of an object and to readjust its size and shape to determine how large of an object would be desirable in a specific location and position on a surface such as a wall.

5. The adjustable picture frame wall hanging template system of claim 1, wherein the adjustable picture frame template includes at least one of a switch configured to manually moving adjustable frame elements adjust by inputting dimensional specifications into an adjustable frame element or an electronic control system to automatically adjust projected visible light patterns.

6. The adjustable picture frame wall hanging template system of claim 1, wherein the temporary adhesive elements are configured to attach to one or more of the multiple adjustable frame elements physical devices.

7. The adjustable picture frame wall hanging template system of claim 1, wherein the leveling elements include bubble levels to indicate the horizontal or vertical orientation of the adjustable picture frame template.

8. An adjustable picture frame template for determining the desired placement, positioning and size of an object to be hung on a surface such as a wall using a device temporarily positioned on the surface for visualizing the object in place prior to being hung, comprising:

a main center piece element configured to house unextended adjustable frame elements and configured to act as a point of connection for extended adjustable frame elements;

a frame corner anchor element configured to act as a point of connection for adjustable frame elements;

an adjustable frame element configured as an extendable assemblage of one or more sections configured to be extended singularly or in tandem with other adjustable frame elements to match the desired object size;

a laser light emitter integrated in a frame corner anchor element to project a band of visible light on the surface to increase the area of visualization of an object;

an adjustable picture frame electronic template having an adjustable laser light emitter elements configured to be adjusted using electronic control systems to project visible light patterns to match the dimensions of the desired object size;

a temporary wall attachment element configured to allow the adjustable picture frame template to be temporarily attached to a surface;

a leveling element attached to the adjustable picture frame template physical elements and configured to allow the template to be adjusted to a horizontal and/or vertical orientation; and an adjustable picture frame template that include elements manufactured of very light materials to allow for less strenuous effort in temporarily positioning and adjusting on a surface.

9. The adjustable picture frame template piece of claim 8, wherein the main center piece has a corresponding shape to the adjustable frame elements and the size of the main center piece houses the assemblage of adjustable frame element sections.

10. The adjustable picture frame template of claim 8, wherein the frame corner anchor houses devices including at least one of laser light emitters, electronic circuits, control systems or power source elements and battery compartments.

11. The adjustable picture frame template of claim 8, wherein the adjustable frame elements includes telescoping elements and channeled panels, tubes and rails and is configured as retractable curved ribbons to act as extendable sections or elements to allow size adjustments.

12. The adjustable picture frame template of claim 8, wherein the temporary wall attachment element includes a mounting tray attached to a physical element, wherein the mounting tray includes at least one of a sticky adhesive, unvulcanized sticky rubber pads, rubber cement or one or more suction cups configured to hold the adjustable picture frame template to a surface for easy removal and repositioning on the surface.

13. The adjustable picture frame template of claim 8, wherein the leveling elements includes bubble levels to indicate the horizontal or vertical orientation of the adjustable picture frame template.

14. An adjustable picture frame electronic template for determining the desired placement, positioning and size of an object to be hung on a surface such as a wall using a device temporarily positioned on the surface for visualizing the object in place prior to being hung, comprising:

an electronic template case configured to attach multiple adjustable picture frame electronic template elements;

a key pad integrated with the adjustable picture frame template and configured to input specific dimensions of an object to be hung on a surface and having a digital memory device to store the user input dimensions for future one-click size inputs and preset default pre-determined picture sizes;

a display configured for reading the inputted dimensions from the key pad;

a laser light emitter element integrated with the adjustable picture frame template and configured to project laser light onto the wall surface in a broad angular light pattern;

a center marking line projected image of the last light emitter configured to provide the user with a reference point to accurately mark the center position for the placement of a nail, screw or hanging device on the wall;

an electronic control system configured to control the operation of the laser light emitter elements and the adjustments of the laser light patterns projected onto the wall surface to match the dimensions inputted from the key pad;

a power source system configured to provide electrical power to the electronic control system and laser light emitter elements;

a temporary wall attachment element configured to allow the adjustable picture frame electronic template to be temporarily attached to a surface; and a leveling element attached to the adjustable picture frame electronic template physical elements to allow the template to be adjusted to a horizontal and/or vertical orientation.

15. The adjustable picture frame electronic template of claim 14, wherein the laser light emitter element includes projection devices, including mirrors, prisms and other optical devices to project laser light onto the wall surface in a broad angular light pattern.

16. The adjustable picture frame electronic template of claim 15, wherein the electronic control system includes a reset button to zero the input dimensions and return the projection angle of the laser light emitter elements to a starting position facing perpendicularly toward the wall.

17. The adjustable picture frame electronic template of claim 15, wherein the electronic control system uses firmware for calculation of the projection angle of the laser light emitter elements to adjust the laser light patterns projected onto the wall surface to match the dimensions inputted from the key pad.

18. The adjustable picture frame electronic template of claim 15, wherein the temporary wall attachment element includes a mounting tray attached to a physical element, wherein the mounting tray includes an adhesive device configured to hold the adjustable picture frame template to a surface for easy removal and repositioning on the surface.

19. The adjustable picture frame electronic template of claim 17, wherein the adhesive device is at least one of sticky adhesive, unvulcanized sticky rubber pads, rubber cement or one or more suction cups.

20. The adjustable picture frame electronic template of claim 15, wherein the leveling elements includes bubble levels to indicate the horizontal or vertical orientation of the adjustable picture frame template.

* * * * *